US008739937B2

(12) United States Patent
Fischer et al.

(10) Patent No.: US 8,739,937 B2
(45) Date of Patent: Jun. 3, 2014

(54) ELEVATOR DAMPING ELEMENT

(75) Inventors: Daniel Fischer, Villarsel-sur-Marly (CH); Dave Mauldin, Long Valley, NJ (US)

(73) Assignee: Inventio AG, Hergiswil (CH)

( * ) Notice: Subject to any disclaimer, the term of this patent is extended or adjusted under 35 U.S.C. 154(b) by 966 days.

(21) Appl. No.: 12/530,704

(22) PCT Filed: Mar. 7, 2008

(86) PCT No.: PCT/EP2008/052796

§ 371 (c)(1), (2), (4) Date: Jun. 9, 2010

(87) PCT Pub. No.: WO2008/110520

PCT Pub. Date: Sep. 18, 2008

(65) Prior Publication Data

US 2011/0132694 A1 Jun. 9, 2011

Related U.S. Application Data

(60) Provisional application No. 60/894,287, filed on Mar. 12, 2007.

(51) Int. Cl.
*B66B 7/08* (2006.01)
*B66B 1/34* (2006.01)

(52) U.S. Cl.
USPC ..... 187/411; 187/393

(58) Field of Classification Search
USPC ..... 187/411, 391, 393, 412, 266.1; 188/266.1

IPC ..... B66B 7/18,1/34
See application file for complete search history.

(56) References Cited

U.S. PATENT DOCUMENTS

| | | | | | |
|---|---|---|---|---|---|
| 949,266 | A | * | 2/1910 | Davey | 187/392 |
| 1,835,544 | A | * | 12/1931 | Werner | 187/280 |
| 1,905,273 | A | * | 4/1933 | Dunlop | 187/264 |
| 4,565,264 | A | * | 1/1986 | Kunii | 187/373 |
| 5,149,922 | A | * | 9/1992 | Kondou | 187/392 |
| 5,611,412 | A | * | 3/1997 | Yoo et al. | 187/412 |
| 5,750,945 | A | * | 5/1998 | Fuller et al. | 187/292 |
| 5,862,888 | A | * | 1/1999 | Iwakiri et al. | 187/345 |

(Continued)

FOREIGN PATENT DOCUMENTS

| | | | |
|---|---|---|---|
| EP | 1 123 891 | A2 | 8/2001 |
| GB | 2 313 926 | A | 12/1997 |
| WO | WO 2005/016812 | A1 | 2/2005 |

*Primary Examiner* — William E Dondero
*Assistant Examiner* — Minh Truong
(74) *Attorney, Agent, or Firm* — Fraser Clemens Martin & Miller LLC; William J. Clemens

(57) ABSTRACT

A fixing point arranged at a guide rail consists substantially of a slide, which is movable along the guide rail and which is guided by guide shoes at the free limb of the guide rail and carries a yoke. A bracket, at which a damping element is supported, is arranged at the guide rail. The end of a belt is held by a connecting element, which in turn is suspended by a tie rod and nuts at the yoke. In the case of an emergency stop situation in which the brake of the drive unit retards the elevator car to standstill, the retardation forces arising in that case are transmitted by belt, connecting element and tie rod to the yoke, wherein the retardation forces produce a displacement of the slide downwardly into the spring-stressed position against the damping capability of the damping element.

12 Claims, 6 Drawing Sheets

(56) References Cited

U.S. PATENT DOCUMENTS

| | | | | |
|---|---|---|---|---|
| 5,878,847 | A * | 3/1999 | Mustalahti et al. | 187/406 |
| 6,065,569 | A * | 5/2000 | Fuller | 187/345 |
| 6,223,862 | B1 * | 5/2001 | Barnes | 187/412 |
| 6,234,276 | B1 * | 5/2001 | Wagatsuma et al. | 187/411 |
| 6,341,669 | B1 * | 1/2002 | St. Pierre et al. | 187/412 |
| 6,435,316 | B1 * | 8/2002 | Ando | 187/411 |
| 6,595,331 | B2 * | 7/2003 | Moncini | 187/408 |
| 2005/0045432 | A1 * | 3/2005 | Ach et al. | 187/411 |

* cited by examiner

ELEVATOR DAMPING ELEMENT

CROSS-REFERENCE TO RELATED APPLICATION

This application is entitled to the benefit of, and claims priority to, provisional patent application Ser. No. 60/894,287 filed Mar. 12, 2007, the entire disclosure of which is incorporated herein by reference.

FIELD OF THE INVENTION

The invention relates to an elevator consisting of an elevator car, which is movable in an elevator shaft along guide rails, and a counterweight, wherein the elevator car and the counterweight are connected by way of a support means guided over rollers and a fixing point is provided for each support means end and a drive drives the support means.

BACKGROUND OF THE INVENTION

A fixing point for an elevator support means has become known from the patent specification U.S. Pat. No. 5,878,847. The support means consists of several support cables, wherein each support cable ends at a cable end connection having a projection which is constructed as a tie rod and which is supported at an L-shaped bracket by means of a compression spring. The compression spring serves for length compensation of the support means. The bracket carrying the compression spring is fastened to a guide rail.

SUMMARY OF THE INVENTION

The invention fulfils the object of reducing, in an emergency stop situation, retardations at an elevator car to an amount acceptable to the elevator passengers.

The coefficients of friction of belts or synthetic fibre cables at the drive pulley are substantially higher than the coefficients of friction of steel cables. In the case of engagement of the drive brake, for example when an emergency stop is triggered by the safety circuit, the slip at the drive pulley is very much less for support means encased by synthetic material than for steel cables. As a consequence thereof very much higher retardation values arise at and in the elevator car. With the fixing point according to the invention for the support means end connections, travel comfort can be maintained, even with modern support means, in an emergency stop situation. A soft emergency stopping has to be guaranteed particularly in the case of high-speed elevators, since excessive decelerations would lead to accidents in the elevator car and injuries to the elevator passengers. The fixing point according to the invention is, in normal operation, fixedly connected with the guide rail or the elevator shaft. In the event of an emergency stop triggered by the safety circuit the fixing point is freed by means of a mechanism, wherein the mechanism and the drive brake are triggered simultaneously. However, the mechanism frees the fixing point before the braking moment produced by the drive brake for retardation of the elevator car is built up. As the braking moment builds up a retardation of the elevator car comes into being, wherein a damping element of the freed fixing point is spring-stressed and the retardation is reduced to an amount acceptable to the elevator passengers. The safety circuit monitors essential safety-relevant functions and preferably comprises a series circuit of contacts for monitoring, for example, door settings of the car door or floor doors, monitoring excess speed of the elevator car, monitoring power supply of the elevator control, monitoring detection of the shaft end, etc. If one of the contacts of the safety circuit is opened an emergency stop is, as explained above, triggered and the drive brake is engaged and the fixing point freed.

In the elevator according to the invention consisting of an elevator car, which is movable in an elevator shaft along guide rails, and a counterweight, the elevator car and the counterweight are connected by way of a support means guided over rollers and a fixing point is provided for each support means end, wherein a drive drives the support means and wherein at least one fixing point comprises a slide, which carries the support means end and which can be released in an emergency stop situation and retardation forces of the elevator car and the counterweight cause a displacement of the slide against the damping capability of a damping element.

DESCRIPTION OF THE DRAWINGS

The present invention is explained in more detail by way of the accompanying figures, in which.

DESCRIPTION OF THE PREFERRED EMBODIMENT

Figure 1:
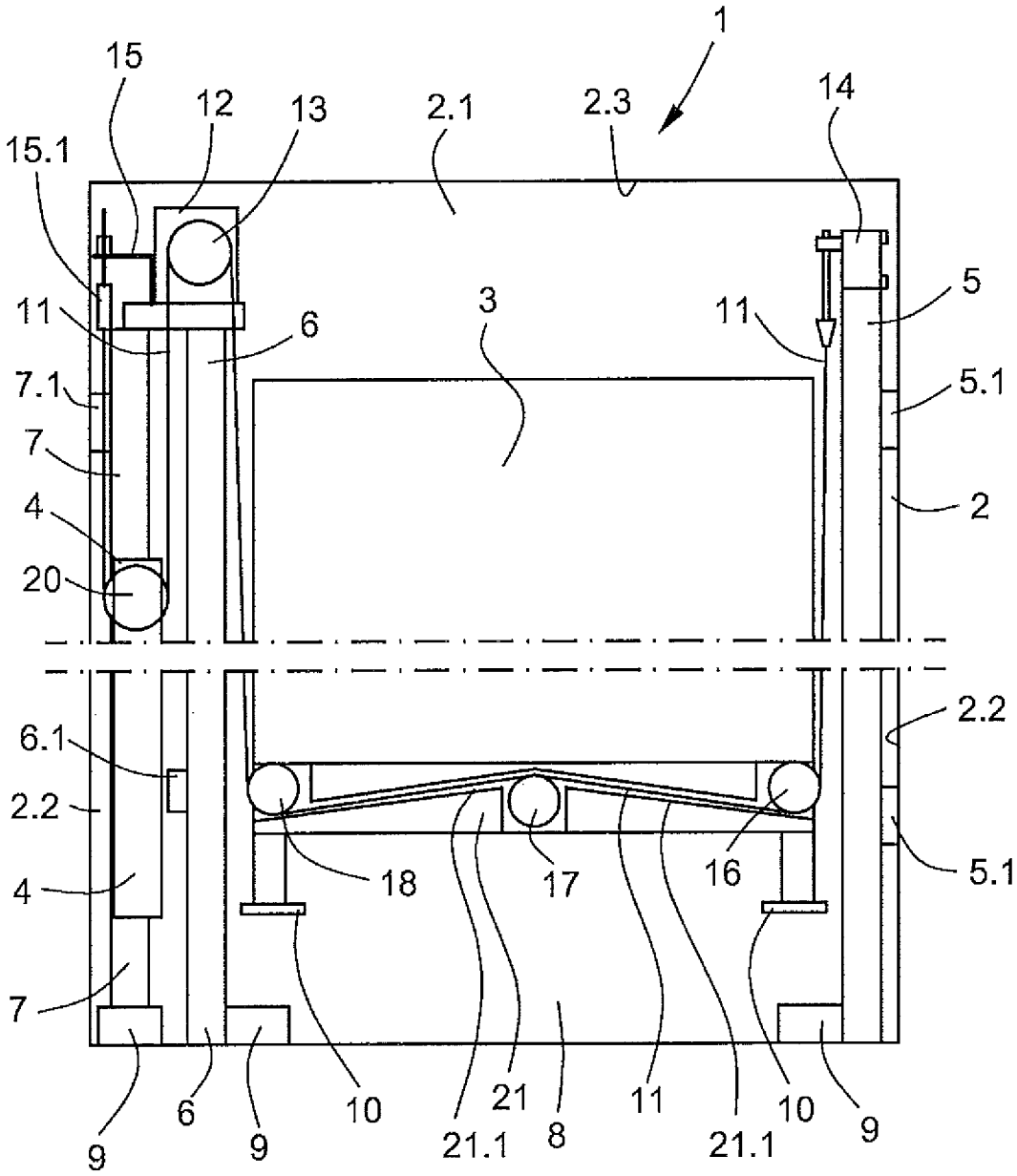
FIG. 1 shows an elevator with the fixing point according to the invention.
Figure 8:
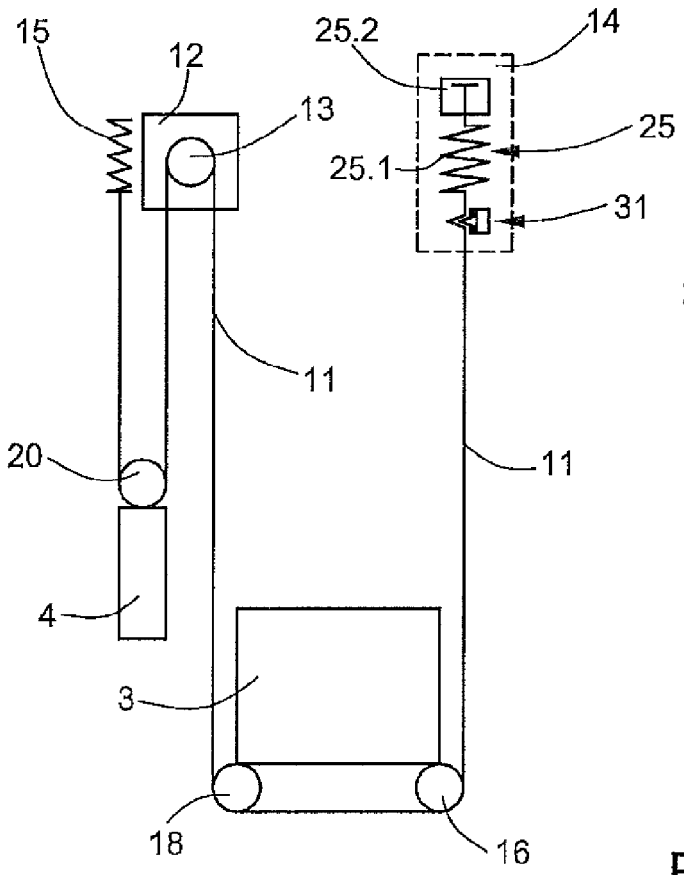
FIG. 8 to FIG. 11 show variants of embodiment of the damping elements.

An elevator denoted by 1 and comprising an elevator car 3, which is movable in an elevator shaft 2, and a counterweight 4 is illustrated in FIG. 1 and FIG. 8. The elevator car 3 is guided by means of a first guide rail 5 and by means of a second guide rail 6. The counterweight 4 is guided by means of a third guide rail 7 and by means of a fourth guide rail (not illustrated). The guide rails are supported in a shaft pit 8, wherein the vertical forces are conducted into the shaft pit 8. The guide rails 5, 6, 7 are connected by brackets 5.1, 6.1, 7.1 with the shaft wall 2.2. Buffers 9 on which buffer plates 10 of the elevator car 3 or the counterweight 4 can settle are arranged in the shaft pit 8.

A steel cable or a synthetic fibre cable or a belt 11 having metallic tensile carriers encased in plastics material, for example a flat belt or a longitudinally ribbed belt, with a 2:1 belt guidance is provided as supporting and driving means. Other belt guidances, such as, for example, 4:1, are also possible. Several belts 11 led in parallel are also conceivable as support means, wherein an individual belt can also consist of several small belts. Drive pulley 13, deflecting rollers 16, 18, 20, profile roller 17 and fixing points 14, 15 are then correspondingly constructed for reception of the belts 11 guided in parallel.

If a drive unit 12 arranged at the second guide rail 6 and third guide rail 7, for example in the shaft head 2.1, drives the belt 11 forwardly by means of a drive pulley 13 through one unit, the elevator car 3 or the counterweight 4 moves by half a unit. The first end of the belt 11 is arranged at a first fixing point 14 and the second end of the belt 11 is arranged at a second fixing point 15. The first fixing point 14 consists of a mechanism 31 for freeing a slide 19 and of at least one damping element 25 for damping retardation forces of the elevator car 3 and the counterweight 4. In FIG. 8 there is provided a mechanism 31, which is constructed as a clamping device and, for example, electrically activatable and which in normal operation firmly clamps the support means. The damping element 25 can be a spring 25.1 and/or a buffer 25.2. The belt 11 is guided over a first deflecting roller 16, a profile roller 17, a second deflecting roller 18, the drive pulley 13 and a third deflecting roller 20. The first deflecting roller 16, second deflecting roller 18 and profile roller 17 are integrated in the floor 21 of the elevator car 3, wherein the belt runs in a floor channel 21.1. The profile roller 17 can also be omitted.

The floor channel 21.1 then runs horizontally. The profile roller 17 has a toothing corresponding with the longitudinal ribs of the belt 11. The first deflecting roller 16 and the second deflecting roller 18 guide the belt, on the untoothed side, by means of flanges arranged at end faces. The drive pulley 13 is disposed in engagement by its toothing, which corresponds with the longitudinal ribs of the belt 11, with the longitudinal ribs of the belt 11. The drive unit 12 comprises a brake for normal operation and for emergency stopping operation. The motor or motors for the drive pulley 13 is or are not illustrated. The fourth deflecting roller 20 is arranged in the counterweight and comparable in construction with the first deflecting roller 16 or with the second deflecting roller 18.

Figure 2:
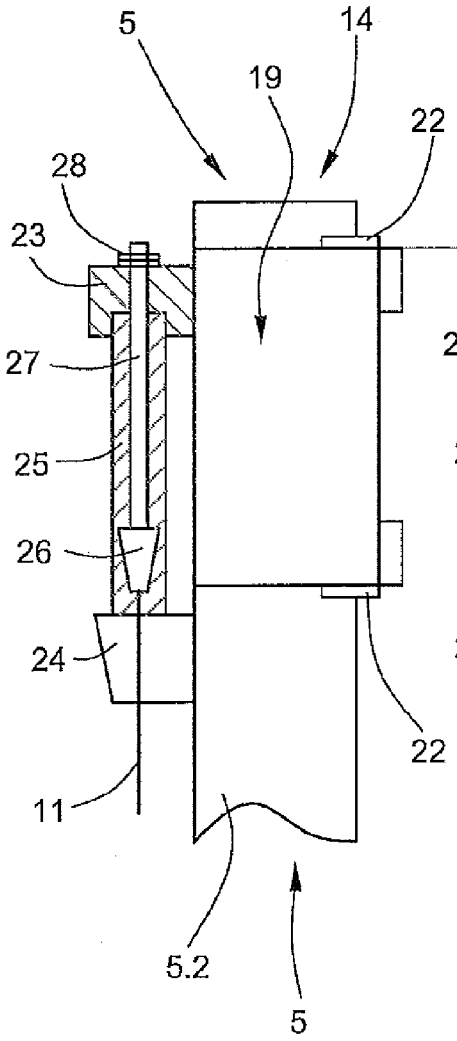
FIG. 2 shows a side view of the fixing point.

FIG. 2 shows a side view of the first fixing point 14, which is provided at the upper end of the first guide rail 5. The first fixing point 14 can also be arranged at the shaft wall 2.2 or at the shaft ceiling 2.3. As shown in FIG. 1, the second fixing point 15 is equipped with longitudinal compensating springs 15.1 which provide compensation for different lengths of the belts 11 guided in parallel. The second fixing point 15 can be of the same construction as the first fixing point and provided with longitudinal compensating springs 15.1. The first fixing point 14 substantially consists of a slide 19 which is movable along the guide rail 5 and which is guided at the free limb 5.2 of the guide rail 5 by means of guide shoes 22 and carries a yoke 23. A bracket 24 at which a damping element 25 is supported is arranged at the guide rail 5. The end of the belt 11 is held by means of a connecting element 26, wherein the belt is guided by way of, for example, a cable firmly clamped in a housing. The housing of the connecting element 26 is suspended at the yoke 23 by means of a tie rod 27 and nuts 28.

Figure 3:
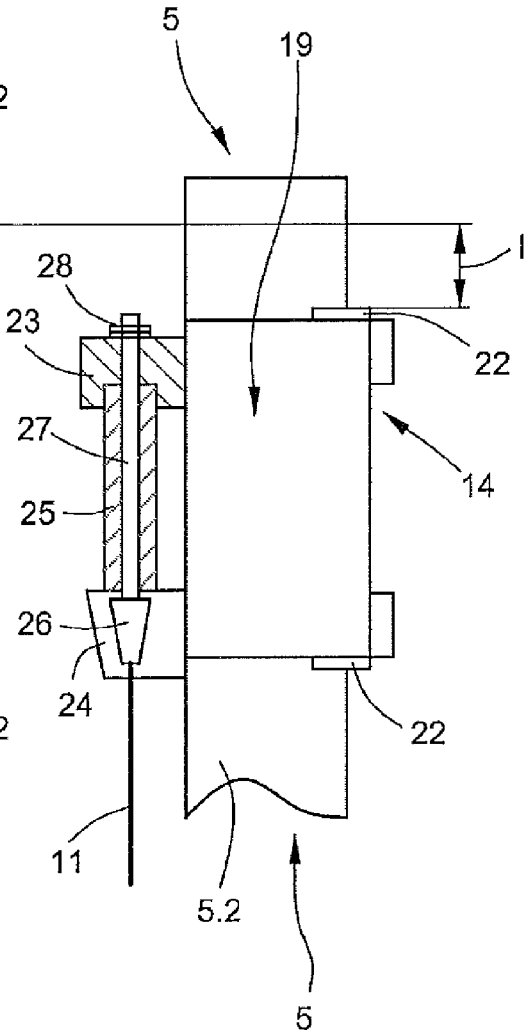
FIG. 3 shows the fixing point at the end of an emergency stop situation.

FIG. 3 shows the fixing point 14 at the end of an emergency stop situation triggered by the safety circuit, in which the brake of the drive unit 12 has retarded the elevator car 3 until standstill. The retardation forces occurring in that case are transmitted by means of belt 11, connecting element 26 and tie rod 27 to the yoke 23 and cause a displacement of the slide 19 through the path I into the spring-stressed position against the damping capability of the damping element 25. The damping element 25 can be, for example, a spring, buffer, hydraulic damper or a hydraulic damper with a spring. In the case of damping elements, which after spring stressing are subject to spring relaxation again, such as, for example, a compression spring, there can be provided a locking device which fixes the slide 19 in the spring-stressed position shown in FIG. 3. With the slide 19 in the position shown in FIG. 3 the elevator car is further movable only at creep speed. An auxiliary spring, which brings the slide 19 back into the starting position after the belt 11 has been relieved by means of buffer travel of the elevator car, can be provided between bracket 24 and yoke 23. Spring-stressed position as shown in FIG. 3, and starting position as shown in FIG. 2, of the slide 19 can be monitored by means of, for example, limit switches.

Figure 4:
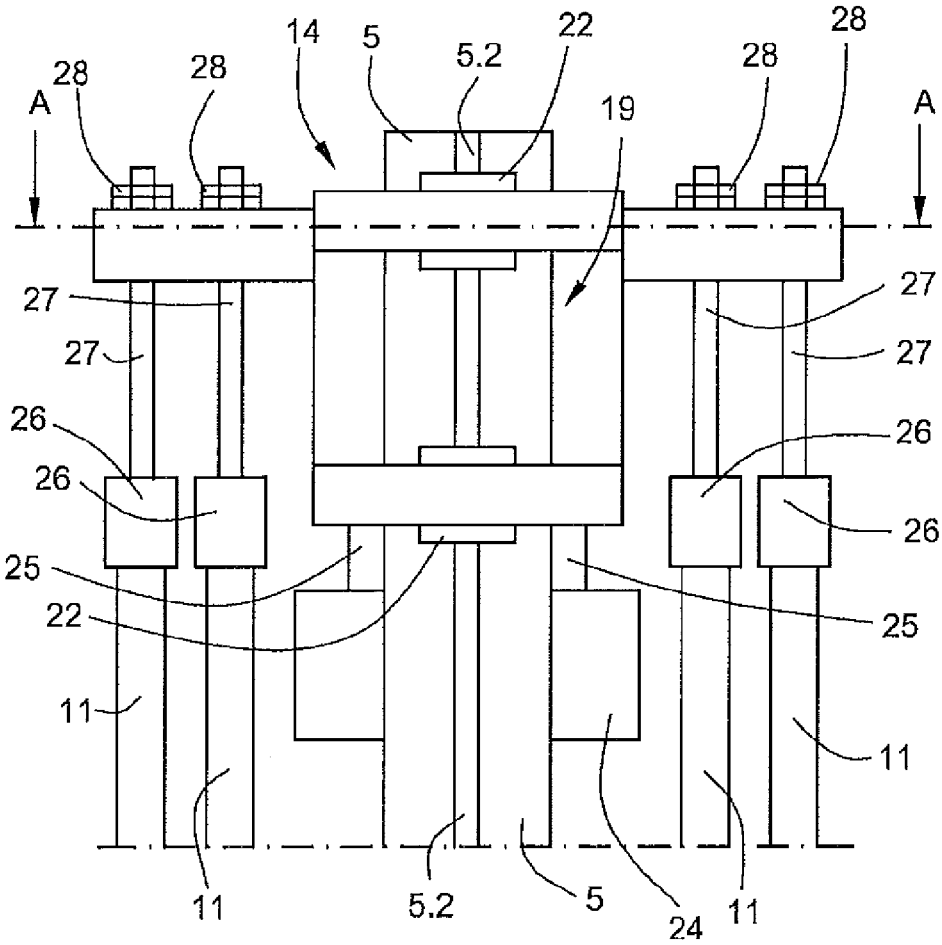
FIG. 4 shows a view of the fixing point as seen from the free limb of a guide rail.
Figure 4A:
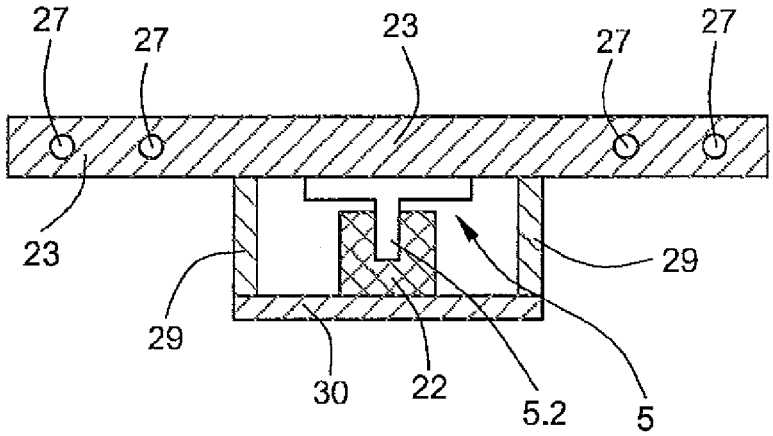
FIG. 4*a* shows a horizontal section A-A of the fixing point.

FIG. 4 shows a view of the fixing point 14 as seen from the free limb 5.2 of the guide rail 5 and FIG. 4*a* shows the section along the line A-A. The fixing point 14 is designed for four belts 11 guided in parallel. An individual belt can also consist of several small belts, wherein each small belt is connected with the yoke by means of connecting element and tie rod. The yoke 23 is arranged between the shaft wall 2.2 and the guide rail 5 and slides at the guide rail 5. The slide 19 consists of side walls 29 which carry the yoke 23 and which are connected with webs 30. A respective guide shoe 22, which can be guided by means of the free limb 5.2, is arranged for each web 30.

Figure 5:
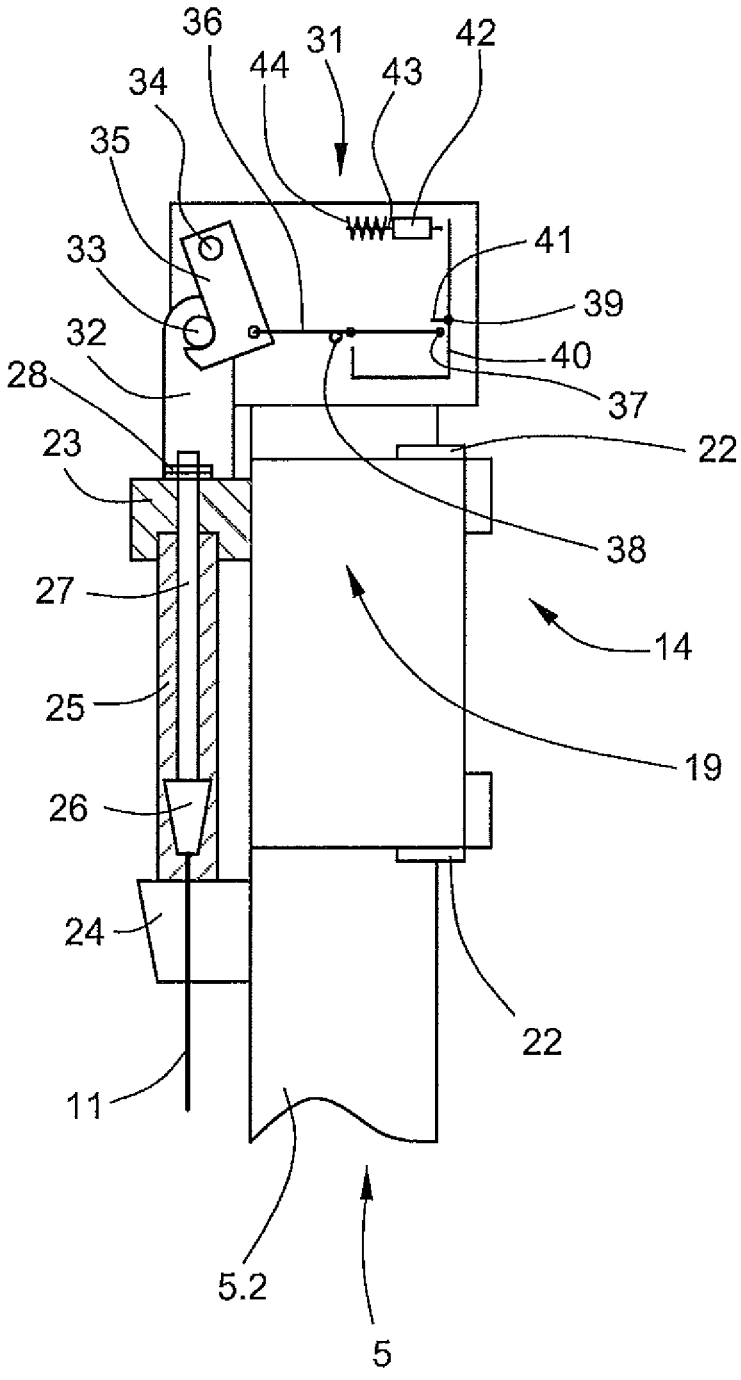
FIG. 5 shows a mechanism for freeing the fixing point.
Figure 6:
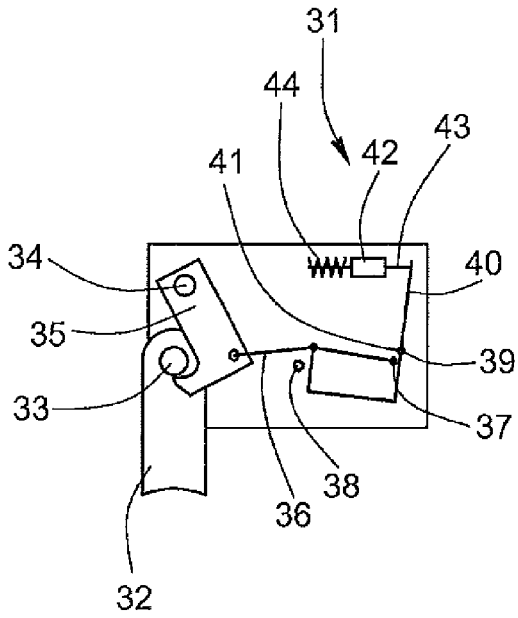
FIGS. 6 and 7 show the process of freeing the fixing point.
Figure 7:
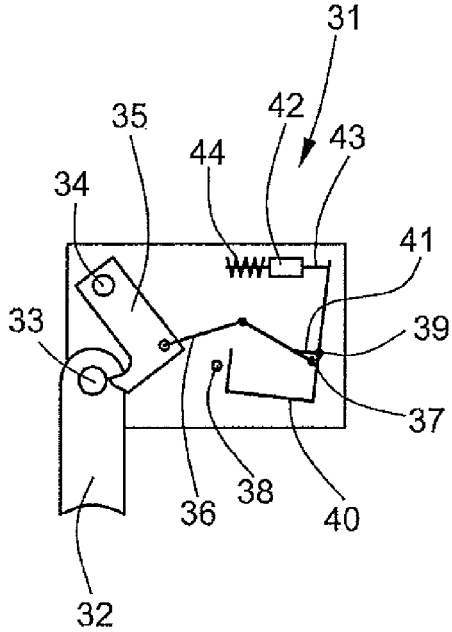

FIG. 5 shows a mechanism 31, which is arranged on the guide rail 5, for freeing the fixing point 14. A strap 32 with a first pin 33 is arranged at the yoke 23, wherein a hook lock 35 rotatable about a first fulcrum 34 engages behind the first pin 33. A toggle joint 36 is articulated at one end at the hook lock 35 and rotatable at the other end about a second fulcrum 37. The toggle joint in the illustrated rest position bears against an abutment 38. A double-arm lever 40 rotatable about a third fulcrum 39 serves for locking and actuation of the toggle joint 36. In the illustrated position the double-arm lever 40 can lock the toggle joint 41, which thus cannot kink in any direction, by means of a cam 41. A coil 42 frees a second pin 43 which rotates the double-arm lever 40 about the third fulcrum 39 by means of the spring force of a compression spring 44. In that case the double-arm lever 40 frees, by its cam 41, the toggle joint 36 and at the same time kinks the toggle joint 36 as shown in FIG. 6. Due to the gravitational force of the elevator car 3 the first pin 33 leaves the hook lock 35 and presses this back again, as shown in FIG. 7. The toggle joint 36 is, in this position, fully kinked.

Figure 9:
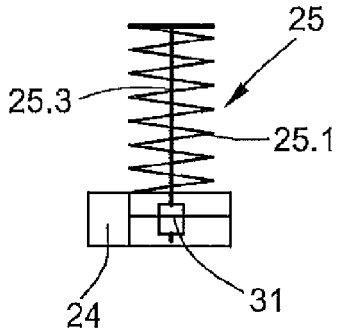
Figure 10:
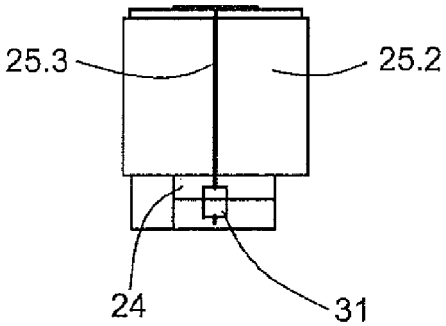
Figure 11:
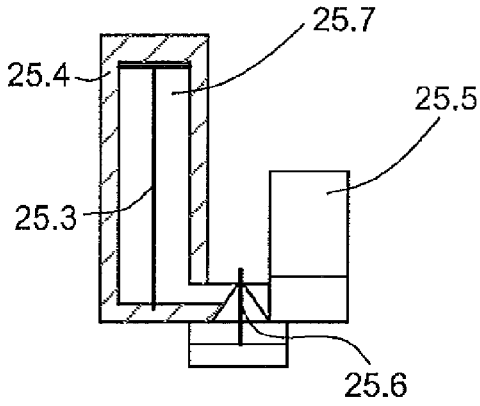

FIG. 9 to FIG. 11 show variants of embodiment of damping elements 25 and of trigger mechanisms 31. As shown in FIG. 9, the damping element 25 consists of a spring 25.1, which after freeing of a plunger 25.3 in an emergency stop operation can be subject to spring stressing. In normal operation of the elevator car 3 the plunger 25.3 is fixed by means of the mechanism 31. In this case the mechanism 31 can be, for example, an electrically actuable latch which prevents the plunger 25.3 from moving or free the plunger 25.3 to move in vertical direction. After stressing of the spring 25.1 the plunger 25.3 is fixed again by way of the mechanism 31. The equipment of FIG. 10 corresponds with the equipment according to FIG. 9 with the difference that there is provided, instead of the spring 25.1, a buffer 25.2, for example a single-use buffer which converts the energy, which is being absorbed, into heat and has to be replaced after an emergency stop situation. FIG. 11 shows a damping element 25 with a hydraulic cylinder 25.4 and an expansion vessel 25.5, wherein the hydraulic cylinder 25.4 and the expansion vessel 25.5 are connected by means of a mechanism 31 in the form of a valve 25.6. In a normal operation of the elevator car 3 the valve 25.6 is closed and the hydraulic cylinder 25.4 is hydraulically separated from the expansion vessel 25.5. In an emergency stop situation the valve 25.6 is opened and the piston or plunger 25.3 of the hydraulic cylinder 25.4 can push the hydraulic medium 25.7 out of the piston and into the expansion vessel 25.5.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. An elevator comprising:

an elevator car movable in an elevator shaft along guide rails;

a counterweight;

a support means connecting and supporting said elevator car and said counterweight;

a drive for driving said support means;

a fixing point attaching an end of said support means in said elevator shaft, said fixing point including a slide and a damping element, said slide carrying said support means end and being held in a starting position by a mechanism during normal operation of said elevator car, said slide being releasable in an emergency stop situation of the elevator by said mechanism when said mechanism is triggered by a safety circuit of the elevator, wherein retardation forces applied to said support means by said elevator car and said counterweight during an emergency stop of said drive produce a displacement of said slide away from the starting position against a damping capability of said damping element;

said fixing point being arranged at one of said guide rails of the elevator and said slide being guided by guide shoes along a free limb of said one guide rail;

a yoke carrying connecting elements of said support means end arranged at said slide and said damping element being arranged between a bracket of said one guide rail and said yoke, said mechanism for holding and releasing said slide being arranged at said one guide rail; and a hook lock of said mechanism detents with a pin of a strap arranged at said yoke and frees said pin in case of an emergency stop operation of said hook lock, said hook lock being actuable by a toggle joint, said toggle joint being kinked by a double-arm lever, and said double-arm lever being actuable by a coil and a compression spring, wherein upon actuation said double-arm lever blocks said toggle joint in a rest position against kinking.

2. An elevator comprising:

an elevator car movable in an elevator shaft along guide rails;

a counterweight;

a support means connecting and supporting said elevator car and said counterweight;

a drive for driving said support means;

a fixing point attaching an end of said support means in said elevator shaft, said fixing point including a slide and a damping element, said slide carrying said support means end and being held in a starting position by a mechanism during normal operation of said elevator car, said slide being releasable in an emergency stop situation of the elevator by said mechanism when said mechanism is triggered by a safety circuit of the elevator, wherein retardation forces applied to said support means by said elevator car and said counterweight during an emergency stop of said drive produce a displacement of said slide away from the starting position against a damping capability of said damping element; and a hook lock of said mechanism detents with a pin of a strap arranged at a yoke carrying connecting elements of said support means end arranged at said slide and frees said pin in case of an emergency stop operation of said hook lock.

3. The elevator according to claim 2 wherein said fixing point is arranged at one of said guide rails of the elevator.

4. The elevator according to claim 3 wherein said slide is guided by guide shoes along a free limb of said one guide rail.

5. The elevator according to claim 3 including a yoke carrying connecting elements of said support means end arranged at said slide.

6. The Elevator according to claim 5 wherein said damping element is arranged between a bracket of said one guide rail and said yoke of said slide.

7. The elevator according to claim 3 wherein said mechanism for releasing said slide is arranged at said one guide rail.

8. The elevator according to claim 2 wherein said hook lock is actuable by a toggle joint, wherein said toggle joint is kinked by a double-arm lever.

9. The elevator according to claim 8 wherein said double-arm lever is actuable by a coil and a compression spring, wherein upon actuation said double-arm lever blocks said toggle joint in a rest position against kinking.

10. The elevator according to claim 2 including another of said fixing point attaching another end of said support means in said elevator shaft and said another fixing point including another said slide and another said damping element.

11. A method of operating an elevator comprising the steps of:

a. providing an elevator car movable in an elevator shaft along guide rails and connected to a counterweight by a support means guided over rollers, the support means being driven by a drive;

b. providing a fixing point for each end of the support means, at least one of the fixing points including a slide and a damping element, the slide carrying the support means end associated with the at least one fixing point and being held in a starting position by a mechanism during normal operation of the elevator car, the mechanism including a hook lock detenting with a pin of a strap arranged at a yoke carrying connecting elements of the support means end arranged at the slide and freeing the pin in case of an emergency stop operation of the hook lock, the slide being releasable in an emergency stop situation of the elevator by the mechanism when the mechanism is triggered by a safety circuit of the elevator, wherein retardation forces applied to the support means by the elevator car and the counterweight during an emergency stop of the drive produce a displacement of the slide away from the starting position against a damping capability of the damping element; and c. releasing the slide by the mechanism before a braking moment for retardation of movement of the elevator car is built up, wherein upon release the at least one fixing point attenuates the retardation forces of the elevator car to an amount acceptable for elevator passengers.

12. The method according to claim 11 wherein when the support means is relieved of load by a buffer travel of the elevator car when the elevator car settles on a buffer in the elevator shaft, a spring force acting between a bracket and a yoke brings the slide into an initial position.

* * * * *